US011428513B2

(12) United States Patent
Chia et al.

(10) Patent No.: US 11,428,513 B2
(45) Date of Patent: Aug. 30, 2022

(54) HIGH PERFORMANCE FOAM DART HAVING RIDGES

(71) Applicant: Easebon Services Limited, Kwun Tong (HK)

(72) Inventors: Francis See Chong Chia, Kowloon (HK); Xubin Xia, Guangdong (CN)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 17/355,591

(22) Filed: Jun. 23, 2021

(65) Prior Publication Data

US 2021/0318105 A1 Oct. 14, 2021

Related U.S. Application Data

(63) Continuation of application No. 16/895,172, filed on Jun. 8, 2020, now Pat. No. 11,073,367.

(60) Provisional application No. 62/859,485, filed on Jun. 10, 2019.

(51) Int. Cl.
*A63B 65/02* (2006.01)
*F42B 6/00* (2006.01)

(52) U.S. Cl.
CPC ..... *F42B 6/003* (2013.01)

(58) Field of Classification Search
CPC ..... F42B 6/003; F42B 6/04
See application file for complete search history.

(56) References Cited

U.S. PATENT DOCUMENTS

| | | | | |
|---|---|---|---|---|
| 7,775,918 | B2 | 8/2010 | Tsang | |
| 8,448,632 | B2 | 5/2013 | Ma | |
| 9,459,081 | B2 | 10/2016 | Chia | |
| 10,018,451 | B1 | 7/2018 | Ma | |
| 10,018,452 | B1 | 7/2018 | Ma | |
| 10,408,583 | B2 | 9/2019 | Isenmann | |
| 10,852,110 | B2 | 12/2020 | Chia et al. | |
| 11,073,367 | B2 * | 7/2021 | Chia | F42B 6/10 |
| 2006/0046877 | A1 | 3/2006 | Gajda, Jr. | |
| 2015/0018144 | A1 | 1/2015 | Chia | |
| 2018/0292189 | A1 | 10/2018 | Isenmann | |
| 2021/0041214 | A1 | 2/2021 | Chia et al. | |

OTHER PUBLICATIONS

Precise Pro Dart, Fandom, https://nerf.fandom.com/wiki/Precise_Pro_Dart, retrieved Sep. 1, 2020, 6 pages.

(Continued)

*Primary Examiner* — John A Ricci
(74) *Attorney, Agent, or Firm* — Amster, Rothstein & Ebenstein LLP

(57) ABSTRACT

A toy dart having an elongate dart body of a foam material in a substantially cylindrical shape extending from a head end to a tail end in a first, longitudinal direction, an outer surface of the substantially cylindrical shape having a first ridge proximate the head end; a second ridge proximate the tail end; and one or more recessed areas disposed between the first ridge and the second ridge, where the elongate dart body has a first outer diameter at the first ridge and the second ridge that is larger than a second outer diameter at the one or more recessed areas; and a deformable dart cap affixed to the head end of the elongate dart body.

18 Claims, 3 Drawing Sheets

(56) References Cited

OTHER PUBLICATIONS

John Haviland, "Getting to the Bottom of Grooved Bullets," American Rifleman, Jul. 2, 2018, https://www.americanrifleman.org/articles/2018/7/2/getting-to-the-bottom-of-grooved-bullets/, retrieved Sep. 1, 2020, 13 pages.

* cited by examiner

HIGH PERFORMANCE FOAM DART HAVING RIDGES

CROSS REFERENCE TO RELATED APPLICATION

The present application claims the benefit of and priority to U.S. patent application Ser. No. 16/895,172, filed Jun. 8, 2020 and entitled HIGH PERFORMANCE FOAM DART HAVING RIDGES, which claims the benefit of and priority to U.S. Provisional Patent Application No. 62/859,485, filed Jun. 10, 2019 and entitled HIGH PERFORMANCE FOAM DART HAVING RIDGES, the entire contents of all of which are incorporated herein by reference.

FIELD

The present invention is generally related to an improved toy dart that includes a cap and a foam body having plural ridges.

BACKGROUND

Manufacturers have been making various types of toy darts, such as a dart having a foam body and a cap attached to one end of the dart body, that may be launched with a compatible toy dart launcher toward a person or an object. The caps of the toys darts are generally made of a material other than foam that allows the dart to be shot from the launcher at a targeted person or object and/or propelled over an appropriate distance and/or at a relatively quick speed.

Conventional dart guns have traditionally been marketed to pre-teen children for casual play. More recently, in conjunction with the advent of special event war games—such as paintball, laser tag, and the like—more high-powered launchers have been developed to target enthusiasts for such special events using foam darts.

As an example, launchers having metal barrels, instead of plastic ones, have been used for improved launching velocity. Such launchers and darts are usually dimensioned to have a very small clearance—between the inner diameter of the barrel of the launcher and the outer diameter of the dart—so as to provide improved launching speed and accuracy. However, the speed and the abrasion between the darts and the barrels, with such high velocities and small clearances, cause the foam outer covering of the darts to melt, thus often requiring consumers to clean out the barrel interior after use.

SUMMARY

In view of the above, it is an object of the invention to provide a foam dart that is suitable for use in high powered launchers.

In accordance with an embodiment of the invention, a foam dart may be dimensioned for use with a launcher with a metal tube having a 13 mm inner diameter for a barrel—for example, a foam dart having about a 12.9 mm outer diameter may be used. The small clearance between the barrel and the dart, therefore, allows for accuracy and distance.

In order to address the above-noted foam dart melting problem with high velocity metal barrel launchers, a foam dart having a reduced surface area may be used. Thus, the present invention is generally related to an improved toy dart that includes one or more recessed areas on a foam body for reducing an overall surface area (or a surface area that contacts a launcher barrel) of the foam body.

In accordance with an exemplary embodiment of the invention, a toy dart comprises an elongate dart body comprising a foam material in a substantially cylindrical shape extending from a head end to a tail end in a first, longitudinal direction, an outer surface of the substantially cylindrical shape comprising: a first ridge proximate the head end; a second ridge proximate the tail end; and one or more recessed areas disposed between the first ridge and the second ridge, wherein the elongate dart body has a first outer diameter at the first ridge and the second ridge that is larger than a second outer diameter at the one or more recessed areas; and a deformable dart cap affixed to the head end of the elongate dart body, the deformable dart cap having a top, a bottom that is affixed into the elongate dart body, and an outer surface extending from the top to the bottom of the deformable dart cap in the first, longitudinal direction.

According to an exemplary embodiment of the invention, the first outer diameter is approximately 12.9 mm.

According to an exemplary embodiment of the invention, the second outer diameter is approximately 12.5 mm to 12.8 mm.

According to an exemplary embodiment of the invention, the second outer diameter is approximately 12.7 mm.

According to an exemplary embodiment of the invention, the first and second ridges form respective first and second rings around the outer surface of the substantially cylindrical shape in relation to the one or more recessed areas.

According to an exemplary embodiment of the invention, the first ridge and the second ridge each extend approximately between 3.5 mm and 6 mm in the first, longitudinal direction.

According to an exemplary embodiment of the invention, at least one of the one or more recessed areas extends approximately between 16 mm and 18.5 mm in the first, longitudinal direction.

According to an exemplary embodiment of the invention, the substantially cylindrical shape of the elongate dart body is approximately between 30 mm and 65 mm in length in the first, longitudinal direction.

According to an exemplary embodiment of the invention, a front edge the first ridge is 3.5 mm or less from the head end.

According to an exemplary embodiment of the invention, the front edge of the first ridge is aligned with the head end.

According to an exemplary embodiment of the invention, a rear edge of the second ridge is 3.5 mm or less from the tail end.

According to an exemplary embodiment of the invention, the rear edge of the second ridge is aligned with the tail end.

According to an exemplary embodiment of the invention, the one or more recessed areas extend in the first, longitudinal direction to form approximately 55-80% of a length of the elongate dart body.

According to an exemplary embodiment of the invention, the one or more recessed areas comprises a plurality of the recessed areas that extend in the first, longitudinal direction to collectively form approximately 75-80% of the length of the elongate dart body.

According to an exemplary embodiment of the invention, the toy dart further comprises one or more additional ridges a predetermined distance from one or more of the first ridge and the second ridge across respective one or more of the plurality of the recessed areas in the first, longitudinal direction, wherein the first ridge, the second ridge, and the one or more additional ridges extend in the first, longitudinal direction to collectively form approximately 20-25% of the length of the elongate dart body.

According to an exemplary embodiment of the invention, the one or more recessed areas extend in the first, longitudinal direction to form approximately 55-70% of the length of the elongate dart body.

According to an exemplary embodiment of the invention, the first ridge and the second ridge extend in the first, longitudinal direction to collectively form approximately 30-45% of the length of the elongate dart body.

According to an exemplary embodiment of the invention, the deformable dart cap comprises two cavities on opposing sides of the outer surface of the deformable dart cap.

The deformable dart cap may be made of one or more materials such as thermoplastic rubber (TPR) that is injection molded.

In embodiments, the deformable dart cap further includes a stem extending therefrom that is configured for insertion into the interior bore of the elongate dart body to affix the bottom of the deformable dart cap into the interior bore at the head end of the elongate dart body. The stem may include one or more grooves for placement of adhesive to bond the deformable dart cap to the elongate dart body.

In embodiments, the deformable dart cap has a top, a bottom that is affixed into the interior bore at the head end of the elongate dart body, and a substantially cylindrically-shaped outer surface extending from the top to the bottom of the deformable dart cap in the first, longitudinal direction. In accordance with an exemplary embodiment of the invention, the substantially cylindrically-shaped outer surface of the deformable dart cap has two cavities the centers of which are spaced approximately 180 degrees from one another on opposing sides of the outer surface of the deformable dart cap. According to an exemplary embodiment of the invention, the cavities each have a generally oval perimeter and approximately a 1-3 mm depth into the interior of the deformable dart cap in a direction that is substantially orthogonal to the first, longitudinal direction. In embodiments, the deformable dart cap comprises In accordance with an exemplary embodiment of the invention, a method of making a toy dart comprises forming a substantially cylindrical foam dart body and applying heat to one or more portions of the foam dart body to form respective one or more recessed areas.

BRIEF DESCRIPTION OF THE DRAWINGS

Exemplary embodiments of the present invention will be described with references to the accompanying figures, wherein.

DETAILED DESCRIPTION

The present invention is generally related to an improved toy dart, such as a foam dart that may be used in a compatible toy dart launcher having a metal barrel. The toy dart has an elongate dart body and a cap that is affixed to the dart body, where the elongate dart body has a configuration that enables the dart to travel through the metal barrel of a launcher at high velocities, while causing reduced heat from friction and attendant melting.

In accordance with an embodiment of the present invention, a toy dart has an elongate dart body, which may comprise foam, having an interior bore extending from a head end to a tail end of the elongate dart body in a first, longitudinal direction, and a deformable dart cap affixed to the head end of the elongate dart body. The deformable dart cap has a top, a bottom that is affixed into the interior bore at the head end of the elongate dart body. The elongate dart body of the toy dart is substantially cylindrical and comprises one or more recessed areas that form a plurality of ridges on the outer surface of the elongate dart body. In embodiments, the plurality of ridges are substantially parallel with one another and protrude in a second direction that is substantially orthogonal to the first, longitudinal direction. In embodiments, the plurality of ridges extend around the elongate dart body to form respective rings.

In accordance with an exemplary embodiment of the invention, a toy dart has an elongate dart body comprising foam and having respective ridges at a head end and a tail end of the elongate dart body in a first, longitudinal direction. According to an exemplary embodiment of the invention, the elongate dart body comprises a recessed area between the respective ridges at the head end and a tail end of the elongate dart body. In embodiments, the elongate dart body further comprises one or more additional ridges between the respective ridges at the head end and the tail end of the elongate dart body.

In accordance with an exemplary embodiment of the invention, a toy dart has an elongate dart body comprising foam that is substantially cylindrical with a length of approximately 30.5 mm in a first, longitudinal direction and has respective ridges at a head end and a tail end of the elongate dart body in a first, longitudinal direction, each of the respective ridges extending approximately 6 mm in the first, longitudinal direction.

According to an exemplary embodiment of the invention, a recessed area between the respective ridges at the head end and the tail end extends approximately 12.5 mm in the first, longitudinal direction.

According to an exemplary embodiment of the invention, the respective ridges at the head end and the tail end of the elongate dart body protrudes by approximately 1 mm from the recessed area in a second direction.

According to an exemplary embodiment of the invention, the second direction is substantially orthogonal to the first, longitudinal direction.

Figure 1:
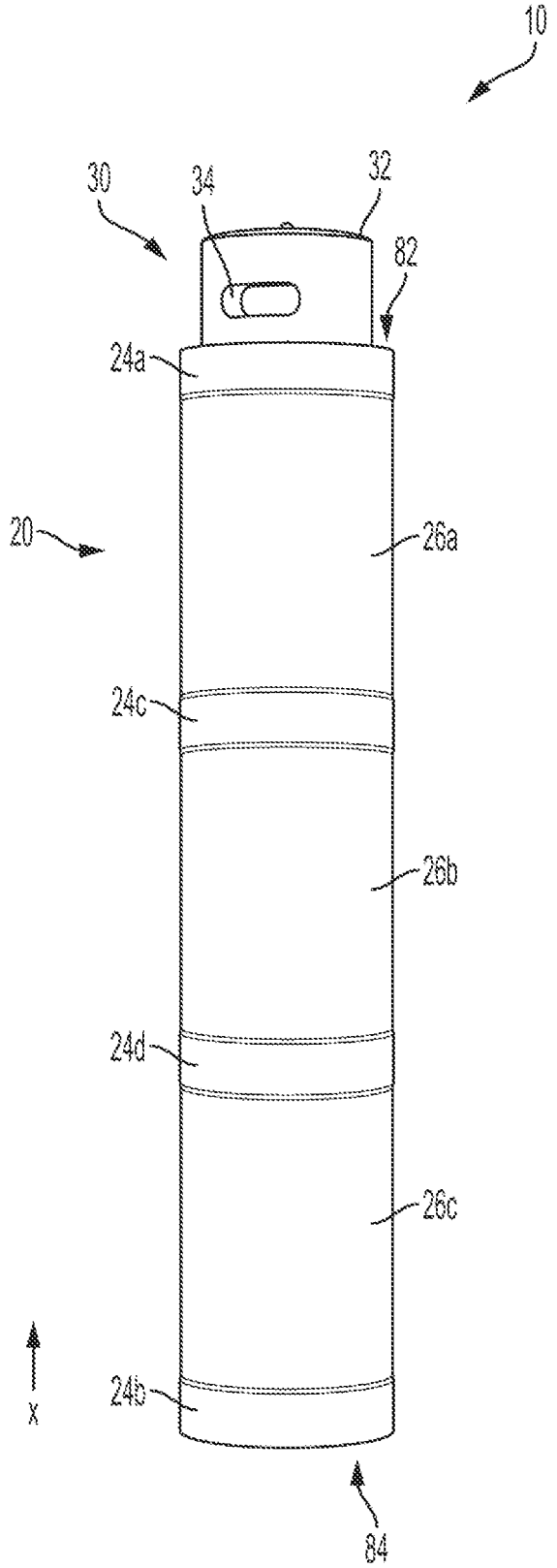
FIG. 1 illustrates a toy dart having a plurality of ridges in accordance with an exemplary embodiment of the invention.

Referring to FIG. 1, a dart 10 in accordance with an exemplary embodiment of the present invention has an elongate profile configured for aerodynamic flight toward a target, such as toward a person or other object. Dart 10 includes an elongate dart body 20 (e.g., foam portion) that extends from a first end (a head end) 82 to a second end (a tail end) 84 of the elongate dart body 20 in a first, longitudinal direction x. Dart 10 further includes a dart cap 30 that is affixed to the head end 82 of the dart body 20. As illustrated in FIG. 1, dart 10 has a total length of approximately 71.5 mm with a length of elongate dart body 20 being approximately 63.5 mm. In other words, dart cap 30 extends approximately 8 mm in the x direction from head end 82 of elongate dart body 20. In embodiments, dart 10 may have a length of about, e.g., within a range of 55 mm and 75 mm, such as 59 mm, 65 mm, 67 mm, 70 mm, 73 mm, or 74 mm, to name a few. As shown in FIG. 1, dart 10 has an outer cross-sectional diameter at its widest point of 12.9 mm, which may be suitable for use with a dart launcher having a metal barrel with an inner diameter of approximately 13 mm, giving an approximately 0.1 mm clearance from dart 10 at its widest point—e.g., at ridges described in further detail below. In embodiments, dart 10 may have an outer cross-sectional diameter at its widest point of, for example, 12.5 mm, 13 mm, 14 mm, or 15 mm, to name a few. In embodiments, dart 10 may be dimensioned so that its outer cross-sectional diameter at its widest point is approximately 0.1-0.2 mm less than an inner diameter of a barrel of a launcher to provide a sufficiently narrow clearance for high velocity and accurate launching. In embodiments, dart 10 may have other lengths, widths, and/or diameters, another example of which is described in further detail below.

Elongate dart body 20 includes a lightweight material, such as a foam, that is suitable for use in a toy projectile. As shown in FIG. 1, dart body 20 is illustrated as having, for example, an outer surface that is substantially cylindrical in shape and, again, elongate dart body 20 may have an outer cross-sectional diameter that is, at its widest point, approximately 12.9 mm. As illustrated in FIG. 1, elongate dart body 20 comprises respective ridges 24*a* and 24*b* at head end 82 and tail end 84 that extend approximately 3.5 mm in the x direction on the outer surface. Additional ridges 24*c* and 24*d* are disposed at regular intervals between ridges 24*a* and 24*b* and they each also extend approximately 3.5 mm in the x direction. Thus, elongate dart body 20 has an outer cross-sectional diameter of approximately 12.9 mm at ridges 24*a*, 24*b*, 24*c*, and 24*d*.

As shown in FIG. 1, recessed areas 26*a*, 26*b*, and 26*c* are disposed between ridges 24*a*, 24*c*, 24*d*, 24*b*, respectively, and each extends approximately 16.5 mm in the x direction. Accordingly, ridges 24*a* and 24*c* are spaced approximately 16.5 mm from one another in the x direction, ridges 24*c* and 24*d* are, likewise, spaced approximately 16.5 mm from one another in the x direction, and ridges 24*d* and 24*b* are spaced approximately 16.5 mm from one another in the x direction. Thus, according to an exemplary embodiment of the invention, recessed areas 26*a*, 26*b*, and 26*c* collectively form approximately 75-80%, or approximately 78%, of the length of elongate dart body 20. Correspondingly, ridges 24*a*, 24*c*, 24*d*, and 24*b* collectively form approximately 20-25%, or approximately 22%, of the length of elongate dart body 20. As illustrated in FIG. 1, ridges 24*a* and 24*b* are disposed at head end 82 and tail end 84 of the elongate dart body 20, respectively, where a front edge of ridge 24*a* is aligned with head end 82 and a rear edge of ridge 24*b* is aligned with tail end 84. In embodiments, ridges 24*a* and 24*b* may be disposed a predetermined distance from head end 82 and tail end 84, respectively—for example, approximately 3.5 mm or less from the respective ends of elongate dart body 20. In other words, ridges 24*a* and 24*b* are disposed near head end 82 and tail end 84, respectively, for maintaining stability of dart 10 while it travels through a barrel (not shown) during launch but may not necessarily need to be completely aligned with head end 82 and tail end 84, respectively—i.e., a front edge of ridge 24*a* may be 3.5 mm or less from head end 82 and a rear edge of ridge 24*b* may be 3.5 mm or less from tail end 84. According to an exemplary embodiment of the invention, dart 10 is launched from a toy launcher (not shown) having a metal barrel with an internal diameter of approximately 13 mm. Advantageously, dart 10 launched from such a toy launcher can achieve accurate flight averaging about 140 ft. (feet) in comparison to an average of 80 ft. with conventional shooters and darts. Additionally, with the reduced friction provided for by recessed areas 26*a-c*, the need for cleaning the metal barrel of the launcher is reduced.

Ridges 24*a*, 24*b*, 24*c*, and 24*d* protrude outwardly in a radial direction on the outer surface of elongate dart body 20 from recessed areas 26*a*, 26*b*, and 26*c* by approximately 0.3 mm (or, in other words, elongate dart body 20 is depressed inwardly at recessed areas 26*a*, 26*b*, and 26*c* by 0.3 mm from ridges 24*a*, 24*b*, 24*c*, and 24*d*). As described above, elongate dart body 20 has an outer cross-sectional diameter of approximately 12.9 mm at its widest point, or at ridges 24*a*, 24*b*, 24*c*, and 24*d*, in accordance with an exemplary embodiment of the invention. Correspondingly, according to an exemplary embodiment of the invention, elongate dart body 20 has an outer cross-sectional diameter of approximately 12.3 mm at recessed areas 26*a*, 26*b*, and 25*c*. In embodiments, ridges 24*a*, 24*b*, 24*c*, and 24*d* may protrude outwardly in a radial direction on the outer surface of elongate dart body 20 from recessed areas 26*a*, 26*b*, and 26*c* by 0.05 mm to 0.5 mm (or, in other words, elongate dart body 20 may be depressed inwardly at recessed areas 26*a*, 26*b*, and 26*c* by 0.05 mm to 0.5 mm from ridges 24*a*, 24*b*, 24*c*, and 24*d*). Accordingly, elongate dart body 20 may have an outer cross-sectional diameter of approximately 11.9 mm to 12.8 mm at recessed areas 26*a*, 26*b*, and 26*c*.

Figure 2:
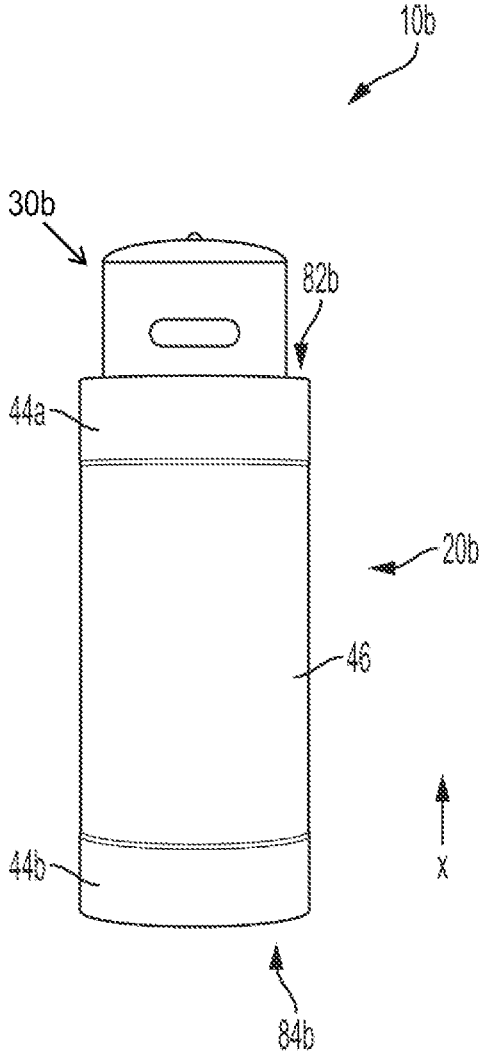
FIG. 2 illustrates a toy dart having a plurality of ridges in accordance with another exemplary embodiment of the invention.

FIG. 2 illustrates a dart 10*b* in accordance with another exemplary embodiment of the present invention. Similar to dart 10 shown in FIG. 1, dart 10*b* has an elongate profile configured for aerodynamic flight toward a target, such as toward a person or other object. Dart 10*b* includes an elongate dart body 20*b* (e.g., foam portion) that extends from a first end (a head end) 82*b* to a second end (a tail end) 84*b* of the elongate dart body 20*b* in a first, longitudinal direction x. Dart 10*b* further includes a dart cap 30*b* that is affixed to the head end 82*b* of the dart body 20*b*.

Dart 10*b* differs from dart 10 in that it is substantially shorter in length for use in, say, a handgun launcher, as an example. As illustrated in FIG. 2, dart 10*b* has a total length of approximately 38 mm with a length of elongate dart body 20*b* being approximately 30.5 mm. In other words, dart cap 30*b* extends approximately 7.5 mm in the x direction from head end 82*b* of elongate dart body 20*b*. In embodiments, dart 10*b* may have a length of about, e.g., within a range of approximately 33 mm to 45 mm, such as 35 mm, 36 mm, 37 mm, or 40 mm, to name a few. Similar to dart 10, dart 10*b* has an outer cross-sectional diameter at its widest point of 12.9 mm. In embodiments, dart 10*b* may have an outer cross-sectional diameter at its widest point of, for example, 12.5 mm, 13 mm, 14 mm, or 15 mm, to name a few.

Elongate dart body 20*b* includes a lightweight material, such as a foam, that is suitable for use in a toy projectile and has an interior bore 25. As shown in FIG. 2, dart body 20*b* is illustrated as having, for example, an outer surface that is substantially cylindrical in shape. As described further below, dart body 20*b* also includes an interior bore (or interior core) that is also cylindrical in shape with, for example, a circular cross-section. As illustrated in FIG. 2, elongate dart body 20*b* comprises respective ridges 44*a* and 44*b* at head end 82*b* and tail end 84*b* that extend approximately 6 mm in the x direction on the outer surface. Recessed area 46 extending approximately 18.5 mm in the x direction is disposed between ridges 44*a* and 44*b*. Accordingly, ridges 44*a* and 44*b* are spaced approximately 18.5 mm from one another in the x direction. Thus, recessed area 46 forms approximately 55-70%, or approximately 61%, of the length of elongate dart body 20*b*. Correspondingly, ridges

44*a* and 44*b* collectively form approximately 30-45%, or approximately 39%, of the length of elongate dart body 20*b*. Given the shorter length of dart body 20*b* in comparison to dart body 20 shown in FIG. 1, it is advantageous to incorporate fewer ridges that, in turn, form a large proportion of the dart body for maintaining launch stability—or improving launch speeds and accuracy. In embodiments, additional one or more ridges may be disposed between ridges 44*a* and 44*b*, with dimensions of ridges and recessed area(s) conforming to the above proportions.

As illustrated in FIG. 2, ridges 44*a* and 44*b* are disposed at head end 82*b* and tail end 84*b* of the elongate dart body 20*b*, respectively. In embodiments, ridges 44*a* and 44*b* may be disposed a predetermined distance from head end 82*b* and tail end 84*b*, respectively—for example, approximately 1.5 mm or less from the respective ends of elongate dart body 20*b*. In other words, ridges 44*a* and 44*b* are disposed near head end 82*b* and tail end 84*b*, respectively, for maintaining stability of dart 10*b* while it travels through a barrel (not shown) during launch but may not necessarily need to be completely aligned with head end 82*b* and tail end 84*b*, respectively.

Ridges 44*a* and 44*b* protrude outwardly in a radial direction on the outer surface of elongate dart body 20*b* from recessed area 46 by approximately 0.1 mm (or, in other words, elongate dart body 20*b* is depressed inwardly at recessed area 46 by 0.1 mm from ridges 44*a* and 44*b*). Again, elongate dart body 20*b* may have an outer cross-sectional diameter that is, at its widest point, approximately 12.9 mm. Thus, elongate dart body 20*b* has an outer cross-sectional diameter of approximately 12.9 mm at ridges 44*a* and 44*b*. In other words, according to an exemplary embodiment of the invention, elongate dart body 20*b* has an outer cross-sectional diameter of approximately 12.7 mm at recessed area 46. In embodiments, ridges 44*a* and 44*b* may protrude outwardly in a radial direction on the outer surface of elongate dart body 20*b* from recessed area 46 by 0.05 mm to 0.2 mm (or, in other words, elongate dart body 20*b* may be depressed inwardly at recessed area 46 by 0.05 mm to 0.2 mm from ridges 44 and 44*b*). Accordingly, elongate dart body 20*b* may have an outer cross-sectional diameter of approximately 12.5 mm to 12.8 mm at recessed area 46.

According to an exemplary embodiment of the invention, elongate dart body 20/20*b* is formed from a foam material into its substantially cylindrical shape—for example, by extruding a hollow rope of foam material (incorporating interior bore 25) and cutting the foam material to predetermined lengths of the elongate dart body (20/20*b*). Thereafter, a metallic (e.g., stainless steel) rod (not shown) is inserted into the hollow bores of the cut pieces and placed into rows of cavities that form lower halves of heated two-piece molds (or a heat press) (not shown) for molding (or pressing) the final shape with the above-described ridges (24*a-d*/44*a-b*) and recessed areas (26*a*, 26*b*, and 26*c*/46). In accordance with an exemplary embodiment of the invention, upper halves of the molds and the lower halves are closed into one another and heated to approximately 80-85° C. (Centigrade)(or 176-185° F.). The upper half and lower half molds are cooled to room temperature before opening for removing the formed elongate dart bodies (20/20*b*). According to an exemplary embodiment of the invention, the process from molding to dart body removal lasts approximately 8 minutes. While recessed areas 26*a*, 26*b*, and 26*c*/46 described above each form a complete ring around elongate dart body 20/20*b*, such areas may not necessarily form such complete rings. For example, such areas may be formed partially around elongate dart body 20/20*b* to form sections of ridges 24*a-d*/44*a-b* that may or may not completely surround elongate dart body 20/20*b*. In addition, raised dots, or other patterns, may be formed in place of ridges 24*a-d*/44*a-b*.

Figure 3A:
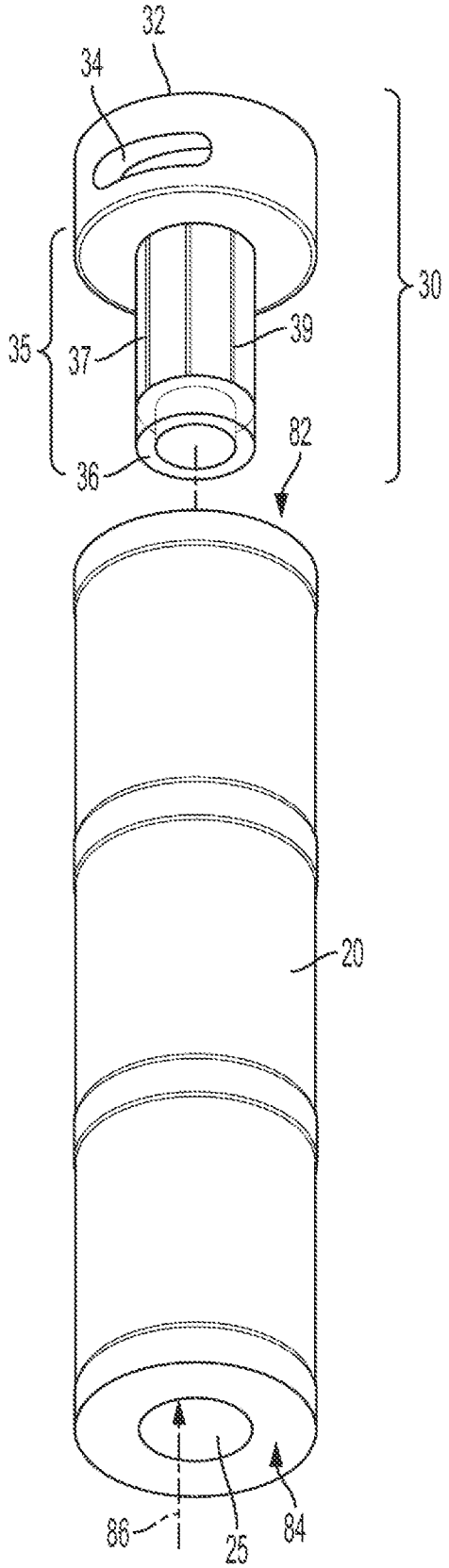
FIGS. 3A and 3B are exploded views of the toy dart, including a dart body and a dart cap, shown from respective first and second perspectives in the orientation of FIG. 1 in accordance with an exemplary embodiment of the invention.
Figure 3B:
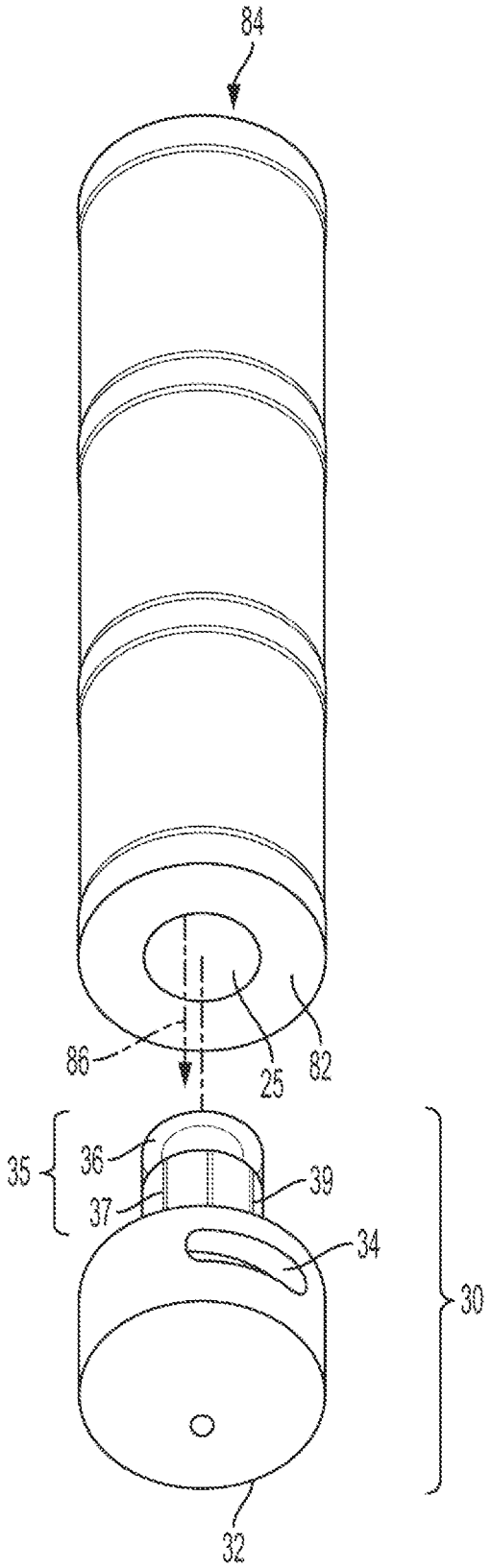

The exploded views of FIGS. 3A and 3B illustrate features related to the assembly of dart cap 30 to elongate dart body 20. It should be noted that dart cap 30*b* shown in FIG. 2 may have a substantially similar configuration to that of dart cap 30 shown in FIGS. 3A and 3B and described below. As described above, dart cap 30*b* may differ from dart cap 30 merely by having a slightly different length in the first, longitudinal direction x (8 mm for dart cap 30 vs. 7.5 mm for dart cap 30*b*) from head end 82 and 82*b*, respectively—with a corresponding difference in pitch of a taper of an outer cylindrical surface of dart cap 30/30*b*, as described in further detail below.

As shown in FIGS. 3A and 3B, elongate body 20 (or, hereinafter, 20*b*) has an interior bore 25 (or interior core) that is also cylindrical in shape with a circular cross-section. In embodiments, interior bore 25 may have a diameter that at its widest point is, for example, 5 mm, 5.5 mm, or 6 mm, to name a few. However, in embodiments, interior bore 25 may have a different diameter. Alternatively, elongate dart body 20 and/or interior bore 25 may have a different cross-sectional shape, such as an oval, pyramidal, diamond, heptagonal, or octagonal shape. Interior bore 25 may extend entirely or at least partially through dart body 20. In embodiments, interior bore 25 of dart body 20 may be lined with materials that provide dart body 20 with certain mechanical properties, e.g., rigidity or resiliency. In exemplary embodiments, the dart body 20 may be formed of one or more pieces. In operation, a compatible toy dart launcher (not shown) may launch dart 10 by forcing air or some other material 86, such as another gas or liquid, through the bottom of interior bore 25 at the tail end of elongate dart body 20, as shown in FIG. 3A. The forced air or other material impinges upon the bottom 36 of stem 35 and causes the launch of the dart 10 toward a target, as illustrated in FIG. 3B.

Dart cap 30 is affixed to head end 82 of dart body 20. As shown in FIGS. 1, 3A, and 3B, dart cap 30 is substantially cylindrical with a slightly tapered outer surface such that a diameter is approximately 10.5 mm at a base end adjacent head end 82 of dart body 20 and approximately 10 mm at a tip end 32 of dart cap 30. In other words, a difference in diameter is approximately 0.5 mm between the base end (adjacent head end 82 of dart body 20) and tip end 32 of the dart cap 30. In embodiments, the taper of the outer cylindrical surface of dart cap 30 may be more or less acute with a difference in diameter between the base end and tip end 32 of between approximately 0.1 mm and 1 mm. As noted above, dart cap 30*b* may have the same approximate diameters, 10 mm at tip end 32 and 10.5 at the base end adjacent head end 82*b* of dart body 20*b*, with a different length than dart cap 30 in the x direction (8 mm vs. 7.5 mm), thus resulting in a different taper pitch on its outer surface.

As shown in FIGS. 1, 3A, and 3B, dart cap 30 includes at least one cavity 34 on the substantially cylindrical (slightly tapered) outer surface thereof. According to an exemplary embodiment of the invention, cavity 34 has a height of approximately 2 mm in the x direction and a width, in a direction that is orthogonal to the x direction, of approximately 5 mm at its widest point. A bottom edge of cavity 34 in the x direction is spaced approximately 2 mm from the base end of dart cap 30 (or head end 82 of dart body 20) and a top edge of cavity 34 in the x direction is spaced approximately 3 mm to 4 mm from tip end 32 of dart cap 30. Cavity 34 is rounded at its width ends and has a depth, extending inward from the substantially cylindrical (slightly tapered) outer surface, of approximately 2 mm to 3 mm. Accordingly, cavity 34 forms a substantially prism-shaped void having a depth of approximately 2 mm to 3 mm in dart cap 30. In embodiments, cavity 34 may have various shapes and depths. According to an exemplary embodiment, another cavity (not shown) that is the same as cavity 34 shown in FIG. 1 is disposed on an opposite side of dart cap 30, the center of which is spaced from the center of cavity 34 by approximately 180 degrees. In embodiments, dart cap 30 may have more or fewer than two (2) cavities with same or different shapes, sizes, and depths—in general, with more cavities forming voids near the base end of dart cap 30 than tip end 32 so that tip end 32 substantially maintains its shape during launch while the base end provides deformation that softens the impact of dart cap 30 on a target.

In exemplary embodiments, dart cap 30 may be integrally formed, such as by injection molding. In alternative exemplary embodiments, dart cap 30 may be formed of one or more pieces. According to an exemplary embodiment of the invention, tip end 32 of dart cap 30 includes a substantially circular surface that is slightly raised at its center. Thus, a center of tip end 32 protrudes by approximately 1 mm in the x direction from a circumference of tip end 32. In embodiments, tip end 32 may be a substantially flat surface or may have a center that protrudes approximately 1 mm from a circumference thereof. In embodiments, tip end 32 of dart cap 30 may be substantially flat, may be tapered, may be curved, such as in the shape of a spherical segment, spherical frustum, or spherical dome, or may have some other shape. Providing a taper or curved top that adds material to the top of dart 10 may enhance the aerodynamic profile of the dart cap to improve the speed and accuracy of the dart and lengthen the distance over which dart 10 can travel.

In particular, FIG. 3A illustrates a dart cap 30 that includes a stem 35 at the bottom of cap 30 that is insertable into interior bore 25 of dart body 20 to affix cap 30 to dart body 20. Stem 35 may be formed integrally with dart cap 30 or may be attached thereto, and may be formed of one or more pieces.

In embodiments, cap 30 is affixed to dart body 20 with an adhesive, such as a glue, that may be applied around stem 35, inside the interior bore 25, to a bottom of dart cap 30, and/or to head end 82 of elongate dart body 20. To provide additional surface area on dart cap 30 to more strongly affix cap 30 to dart body 20, stem 35 may include one or more grooves, such as grooves 37 and 39 that extend along direction x and that can accommodate additional adhesive. In embodiments, dart cap 30 may be affixed to dart body 20 in a manner other than with an adhesive.

Although stem 35 is illustrated with a particular design, it should be understood that the stem 35 for dart cap 30 is not limited to the illustrated design, and may be shaped and/or sized differently. For example, there may not be any grooves and stem 35 may have an enlarged plug attached to the bottom of stem 35 to help hold stem 35 within interior bore 25.

Dart cap 30 is made to be heavier than the relatively lightweight configuration of dart body 20, such as by choosing a particular composition of material, so as to position the center of gravity of dart 10 toward the head of the dart 10. This improves the accuracy and aerodynamics of dart 10.

It should be understood that, as with the dimensions of elongate dart body 20, the dimensions of dart cap 30 and structures thereof may vary. For example, in embodiments, the height of dart cap 30 excluding the height of stem 35 may be in a range of 6-9 mm, stem 35 has a length, such as a length of at least 5 mm, and a diameter that is sized to fit and securely hold dart cap 30 within interior bore 25, and grooves 37, 39 within stem 35 may be in a range of 0.5 to 0.7 mm in width. However, in embodiments, dart cap 30 and structures thereof may have different dimensions, such as different lengths, heights, widths, and/or diameters.

In embodiments, dart cap 30 is made of a soft, flexible and/or resilient material, that can be injection molded. For example, dart cap 30 may be made of injection molded thermoplastic rubber (TPR). In embodiments, cap 30 could alternatively be made of, for example, polyvinyl chloride (PVC), styrene-butadiene-styrene (SBS), or ethylene-vinyl acetate (EVA), to name a few. In embodiments, dart cap 30 has a Shore durometer measurement that is sufficiently rigid to maintain the integrity of the cap but relatively soft to lessen the impact on a target. According to an exemplary embodiment of the invention, the molding material has a Shore A durometer of approximately 35. In embodiments, the molding material may have a Shore A durometer that is within a range of 15 to 80. In embodiments, the molding material may have a Shore A durometer that is within a range of 20 to 80, or a range of 20 to 70, or a range of 40 to 70, or a range of 20 to 60, or a range of 30 to 60, or a range of 20 to 40, to name a few. In embodiments, the molding material may have a Shore A durometer that is approximately 30, or approximately 40, or approximately 50, or approximately 70, to name a few. In embodiments, the molding material may have a Shore A durometer that is at least 20, or at least 30, or at least 40, to name a few. In embodiments, the molding material may have a Shore A durometer that is no more than 80, or no more than 70, or no more than 50, to name a few.

According to an exemplary embodiment of the invention, dart cap 30/30*b* has a Shore A durometer of approximately 35. In embodiments, the cap may have a Shore A durometer that is within a range of 15 to 80, or a range of 20 to 80, or a range of 20 to 70, or a range of 40 to 70, or a range of 20 to 60, or a range of 30 to 60, or a range of 20 to 40, to name a few. In embodiments, the cap may have a Shore A durometer that is approximately 30, or approximately 40, or approximately 50 or approximately 70, to name a few. In embodiments, the cap may have a Shore A durometer that is at least 20, or at least 30, or at least 40, to name a few. In embodiments, the cap may have a Shore A durometer that is no more than 80, or no more than 70 or no more than 50, to name a few. In embodiments, dart cap 30 may be measured along a different Shore durometer scale, such as Shore D, for example.

Figure 4C:
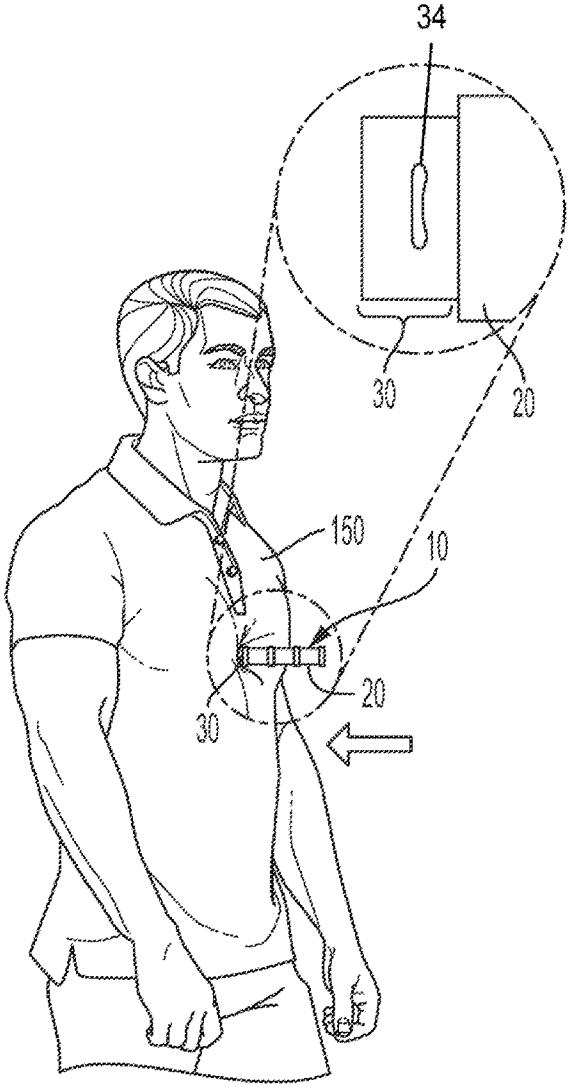
FIG. 4C shows an example of how the cap of the toy dart of FIG. 4A may deform upon impact.
Figure 4B:
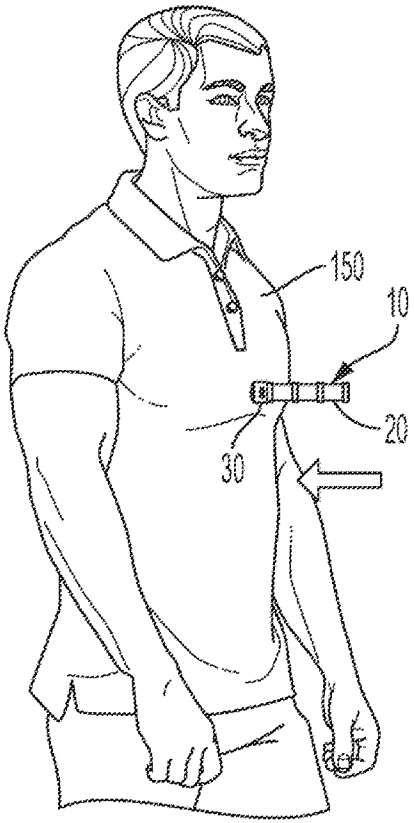
FIG. 4B shows the toy dart of FIG. 4A on initial impact on the person.
Figure 4A:
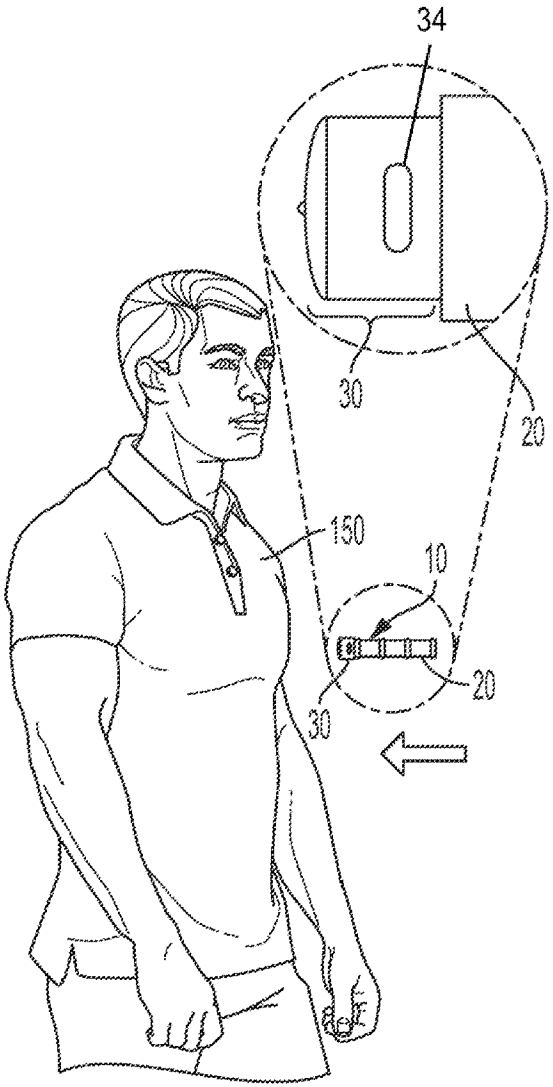
FIG. 4A shows the toy dart in accordance with an embodiment of the invention on an incoming path toward a targeted person.

FIGS. 4A to 4C illustrates an exemplary launch of dart 10 (or dart 10*b*) toward a person from a compatible toy dart launcher (not shown). The compatible toy dart launcher may launch dart 10 by forcing air or some other material 86, such as another gas or liquid, through the bottom of interior bore 25 at the tail end of elongate dart body 20 as shown in FIG. 3A. The forced air or other material impinges upon the bottom 36 of stem 35 and causes the launch of the dart 10 toward a target. In embodiments, dart 10 may be launched through a flywheel mechanism, and the like. As shown in FIG. 4A, dart 10 has been launched and comes into proximity with a person 150. At FIG. 4B, dart 10 impacts upon and makes contact with the person's shirt. At FIG. 4C, dart 10 presses into person 150, with dart cap 30 deforming so as to safely soften the impact on the person and at least limit injuries that may be caused by the impact. As can be seen in the enlarged view within FIG. 4C, cavity 34 of dart cap 30 deforms upon the initial impact of dart 10. After impacting the person, dart 10 bounces off and dart cap 30 may resiliently substantially return to its original shape, such as for relaunching. Although not shown, it should be understood that the lightweight material, such as foam, of dart body 20 may also deform to a certain extent upon impact. It is desirable that the upper portion of dart cap 30, including tip end 32, remains relatively more rigid in order to reduce deformation of the dart cap 30 at launch and to reduce wobble during flight, thereby improving upon the stable aerodynamics—and correspondingly, the speed and accuracy—of dart 10 in hitting its intended target.

Changes to the dart cap design may take into account the complexity of the mold that is required, the cost for additional materials, and any increased weight and/or rigidity of the toy dart, which may impact the aerodynamics and safety of the toy dart.

Additionally, changes to the elongate dart body design may take into account the complexity of the mold that is required and the stability of the dart during launch. For example, the exemplary embodiments show respective ridges that are substantially parallel with one another (and orthogonal to the first, longitudinal direction) on an outer surface of the elongate dart body. However, different non-parallel and/or non-orthogonal patterns may be used—for example, diagonal and/or criss-crossing patterns, dots, and the like. Such patterns may take into account the relationship among the length of the elongate dart body, ridges, and recessed areas—and corresponding surface area proportions—of the exemplary embodiments described above.

While particular embodiments of the present invention have been shown and described in detail, it would be obvious to those skilled in the art that various modifications and improvements thereon may be made without departing from the spirit and scope of the invention. It is therefore intended to cover in the appended claims all such modifications and improvements that are within the scope of this invention.

What is claimed is:

1. A toy dart, comprising:

an elongate dart body comprising a foam material in a substantially cylindrical shape extending from a head end to a tail end in a first, longitudinal direction, an outer surface of the substantially cylindrical shape comprising:

(1) a first ridge;

(2) a second ridge; and (3) one or more recessed areas disposed between the first ridge and the second ridge, wherein the elongate dart body has a first outer diameter at the first ridge and the second ridge that is larger than a second outer diameter at the one or more recessed areas, and a deformable dart cap affixed to the head end of the elongate dart body, the deformable dart cap having a top, a bottom that is affixed into the elongate dart body, and an outer surface extending from the top to the bottom of the deformable dart cap in the first, longitudinal direction.

2. The toy dart of claim 1, wherein the first outer diameter is approximately 12.9 mm.

3. The toy dart of claim 1, wherein the second outer diameter is approximately 12.5 mm to 12.8 mm.

4. The toy dart of claim 3, wherein the second outer diameter is approximately 12.7 mm.

5. The toy dart of claim 1, wherein the first and second ridges form respective first and second rings around the outer surface of the substantially cylindrical shape in relation to the one or more recessed areas.

6. The toy dart of claim 1, wherein the first ridge and the second ridge each extend approximately between 3.5 mm and 6 mm in the first, longitudinal direction.

7. The toy dart of claim 6, wherein at least one of the one or more recessed areas extends approximately between 16 mm and 18.5 mm in the first, longitudinal direction.

8. The toy dart of claim 7, wherein the substantially cylindrical shape of the elongate dart body is approximately between 30 mm and 65 mm in length in the first, longitudinal direction.

9. The toy dart of claim 1, wherein a front edge the first ridge is 3.5 mm or less from the head end.

10. The toy dart of claim 9, wherein the front edge of the first ridge is aligned with the head end.

11. The toy dart of claim 1, wherein a rear edge of the second ridge is 3.5 mm or less from the tail end.

12. The toy dart of claim 11, wherein the rear edge of the second ridge is aligned with the tail end.

13. The toy dart of claim 1, wherein the one or more recessed areas extend in the first, longitudinal direction to form approximately 55-80% of a length of the elongate dart body.

14. The toy dart of claim 13, wherein the one or more recessed areas comprises a plurality of the recessed areas that extend in the first, longitudinal direction to collectively form approximately 75-80% of the length of the elongate dart body.

15. The toy dart of claim 14, further comprising one or more additional ridges a predetermined distance from one or more of the first ridge and the second ridge across respective one or more of the plurality of the recessed areas in the first, longitudinal direction, wherein the first ridge, the second ridge, and the one or more additional ridges extend in the first, longitudinal direction to collectively form approximately 20-25% of the length of the elongate dart body.

16. The toy dart of claim 13, wherein the one or more recessed areas extend in the first, longitudinal direction to form approximately 55-70% of the length of the elongate dart body.

17. The toy dart of claim 16, wherein the first ridge and the second ridge extend in the first, longitudinal direction to collectively form approximately 30-45% of the length of the elongate dart body.

18. The toy dart of claim 1, wherein the deformable dart cap comprises two cavities on opposing sides of the outer surface of the deformable dart cap.

* * * * *